US005161128A

United States Patent [19]

Kenney

[11] Patent Number: 5,161,128

[45] Date of Patent: Nov. 3, 1992

[54] CAPACITIVE TRANSDUCER SYSTEM AND METHOD

[75] Inventor: Martin J. Kenney, Startup, Wash.

[73] Assignee: Ultrasonic Arrays, Inc., Woodinville, Wash.

[21] Appl. No.: 621,265

[22] Filed: Nov. 30, 1990

[51] Int. Cl.[5] ..... H04R 19/00

[52] U.S. Cl. ..... 367/181; 310/309; 361/271; 381/191

[58] Field of Search ..... 307/400; 310/309; 361/271, 272, 301, 277; 367/181; 381/174, 191

[56] References Cited

U.S. PATENT DOCUMENTS

| | | | |
|---|---|---|---|
| 3,041,418 | 1/1962 | Lazzery | 381/174 |
| 3,373,251 | 3/1968 | Seeler | 381/159 |
| 3,786,495 | 1/1974 | Spence | 367/181 |
| 4,695,986 | 9/1987 | Hossack | 367/140 |
| 4,769,793 | 9/1988 | Kniest et al. | 367/99 |
| 4,823,590 | 4/1989 | Kniest et al. | 367/140 |
| 4,887,246 | 12/1989 | Hossack et al. | 367/140 |

OTHER PUBLICATIONS

Kuhl et al., "Condenser Transmitters and Microphones . . . ", *ACUSTICA*, vol. 4, No. 5 (1954) National Semiconductor LM-1830 Fluid Detector.

*Primary Examiner*—Brian S. Steinberger

*Attorney, Agent, or Firm*—Mason, Kolehmainen, Rathburn & Wyss

[57] ABSTRACT

A capacitive transducer including a back plate and a tensioned dielectric diaphragm with a conductive layer is operated as a sonic energy emitter and receiver. The polarity of the dc bias applied to the transducer is periodically reversed to prevent charging and polarization of the dielectric diaphragm due to the applied electrostatic field. The bias voltage polarity is controlled in timed sequence with the application of a fluctuating voltage to generate sonic energy with optimum efficiency. Electrical signals resulting from received sonic energy are selectively inverted and provided with compensation for differences resulting from differences in bias polarities.

22 Claims, 2 Drawing Sheets

CAPACITIVE TRANSDUCER SYSTEM AND METHOD

FIELD OF THE INVENTION

The present invention relates to improvements in systems including capacitive transducers and methods for operating capacitive transducers.

DESCRIPTION OF THE PRIOR ART

Capacitive transducers include a pair of spaced electrodes that are capacitively coupled to one another. Relative movement of the electrodes is caused by or causes variations in electrical signals coupled to or from the transducer electrodes. Such devices have found use as generators and receivers of sonic signals including audible and ultrasonic signals.

A known type of capacitive transducer includes a relatively rigid and massive fixed back plate and a diaphragm overlying the back plate. The back plate constitutes one of the electrodes, and a metal layer on the diaphragm is the other electrode. One such device is described in Kuhl et al., "Condenser Transmitters And Microphones With Solid Dielectric For Airborne Ultrasonics", *ACUSTICA*, Vol. 4, No. 5 (1954). The Kuhl et al. transducer includes a film of insulating material stretched over a back plate having a grooved or roughened surface. The external surface of the film has a grounded conductive metal layer. A dc voltage is applied to the back plate for polarization. This applied dc voltage presses the foil against the roughened surface of the back plate. If the transducer is used as a transmitter, an ac voltage is applied to the back plate and sound energy is radiated. If the transducer is used as a microphone, sound energy impinging on the foil results in electrical signals.

U.S. Pat. No. 3,041,418 discloses a sonic transducer including a perforated, bowed, rigid plate. A polyester film with a thin metal coating overlies the plate. A voltage of desired frequency is applied to cause the diaphragm to vibrate. For use as a microphone, a polarizing voltage is applied to the transducer.

U.S. Pat. No. 3,373,251 discloses an electrostatic transducer for use as a microphone or loudspeaker with a thin film diaphragm having a conductive coating. The inner diaphragm surface is positioned on a porous metal back plate. The diaphragm is biased in order to provide an electrostatic field that causes the diaphragm to be stretched across the back plate. The biasing is provided externally by the application of a dc voltage or internally by using an electret diaphragm.

U.S. Pat. No. 4,695,986 and 4,887,246 disclose ultrasonic transducers including flexible metallized diaphragms overlying rigid backing plates. The backing plate surface is provided with grooves or supports that are engaged by the inner surface of the diaphragm.

Transducers of this type are subject to a serious problem that occurs if the transducer becomes charged. As a result of the applied dc bias voltage, the dielectric material of the diaphragm is subjected to an electrical field of substantial strength. The dielectric material can become electrically charged, probably due to the transfer of charge between the dielectric and the back plate, or due to polarization of the dielectric, or due to both causes. When the diaphragm becomes charged, the performance of the transducer is degraded because the charged dielectric is repelled by the back plate, cancelling part or all of the force of attraction between the metal layer on the diaphragm and the back plate.

This problem was recognized in 1954 by Kuhl et al., cited above, who noted the decrease in sensitivity of a transducer after a period of application of constant dc voltage. That publication suggested that materials might be selected to minimize the problem or that cleaning the diaphragm with alcohol was helpful. In addition, Kuhl et al. recognized that sensitivity of a charged dielectric could be restored temporarily by removing the applied dc voltage, an approach similar to the use of an electret proposed in above cited U.S. Pat. No. 3,373,251.

Capacitive transducers are widely used for industrial applications such as thickness measuring and the like where continuous or frequent measurements are made in high temperature environments. The transducer charging problem is exacerbated by high temperatures. Solutions to the problem suggested in the past have not been effective. Materials that are preferred for industrial measuring applications are subject to the charging problem. Preparation or cleaning of the materials used in the transducer has not overcome the difficulty. The periodic removal of the dc bias voltage is not practical due to the requirement for continuous or a continuing sequence of frequent measurements.

SUMMARY OF THE INVENTION

It is a primary object of this invention to provide a system and a method for avoiding the charging problem of capacitive transducers. Other objects are to provide a system and method for preventing charging over time due to charge movement or polarization or the like; to provide a method and system that do not interfere with continuous or frequent transducer operation; to provide a system and method that permit a capacitive transducer to operate as a source or receptor of sonic energy or both; and to provide a capacitive transducer system and method overcoming difficulties experienced with capacitive transducers used in the past.

In brief, a capacitive transducer system in accordance with the present invention includes a transducer having spaced capacitively coupled electrodes. One of the electrodes is a conductive back plate. A diaphragm overlying the back plate includes a dielectric film with a metal layer on the surface of the film opposed to the back plate. The metal layer provides the other of the electrodes. A bias circuit is connected to the transducer for applying a bias voltage between the electrodes for biasing the transducer to an operating condition. A signal circuit connected to the electrodes processes signals transduced by the transducer. The system is characterized by the bias circuit including polarity control means for periodically reversing the polarity of the bias voltage to decrease charging of the dielectric film.

In brief, the present invention provides a method of operating a capacitive transducer of the type including a conductive back plate and a dielectric film with a metal coating overlying the back plate. The method includes applying a dc voltage to the back plate and metal film to attract the metal film toward the back plate with an electrostatic force. Electrical signals causally related to movement of the metal film relative to the back plate are transferred between the transducer and a signal circuit. The polarity of the applied dc potential is periodically reversed

DESCRIPTION OF THE VIEWS OF THE DRAWINGS

The present invention together with the above and other objects and advantages may be best understood from the following detailed description of the embodiment of the invention shown in the drawings, wherein.

DETAILED DESCRIPTION OF THE PREFERRED EMBODIMENT

Figure 1:
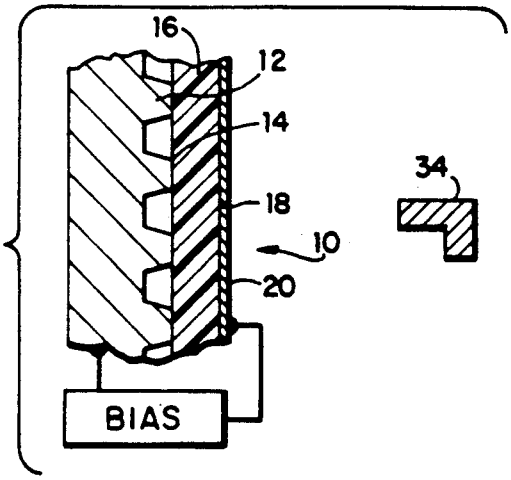
FIG. 1 is a greatly enlarged and highly diagrammatic fragmentary view of a capacitive transducer of the type to which the present invention is applicable.

In FIG. 1 of the drawings there is illustrated a portion of a capacitive transducer 10 to which the principles of the present invention may be applied. In general, transducer 10 includes a rigid conductive metal back plate 12 of aluminum or similar metal with a surface 14 that is roughened or grooved or the like. Stretched in tension across the back plate surface 14 is a diaphragm 16 made of dielectric, plastic film material. The preferred material is a polyimide or polyetherimide film such as Kapton. The outer surface 18 of the diaphragm 16 is provided with a conductive coating or layer 20 of metal such as gold permanently adhered to the dielectric material of the diaphragm. The inner surface 22 of the diaphragm 16 is uncoated. Surface 14 of the back plate 12 is roughened or grooved or textured to provide gaps where air is trapped. The structure of the transducer 10 may be as further described in U.S. Pat. No. 4,887,246, incorporated here by reference.

Capacitive coupling between the back plate 12 and the conductive layer 20 permits operation as a transducer. The back plate 12 and layer 20 constitute the two electrodes of the transducer and function as two plates of a capacitor separated by the dielectric material of the diaphragm 16 and by air trapped between the back plate surface 14 and the diaphragm surface 22. Electrical signals can be used to move the layer 20 and diaphragm 16 to transmit sonic energy, or impinging sonic energy can move diaphragm 16 with the layer 20 to create electrical signals.

In conventional operation of transducer 10, a constant dc bias voltage is applied across the back plate 12 and the conductive layer 20 by grounding the layer 20 and applying a dc bias potential to back plate 12 through a connecting cable. The bias voltage urges the diaphragm 16 against the surface 14 of the back plate 12 by electrostatic attraction. This electrostatic attraction force is opposed by the restoring force of tension in the diaphragm 16. The bias potential enables the transducer 10 to operate efficiently as a transducer. When the diaphragm 16 is tight against the surface 14, the change in capacitance resulting from movement of the diaphragm 20 is maximized, and performance of the transducer both in emitting and receiving sonic energy is increased.

When the transducer is enabled for operation by the application of a dc bias potential, a fluctuating electrical signal can be applied to cause the diaphragm 20 to move and emit sonic energy. One way to do this is to sharply reduce the voltage on the back plate 12 and generate a pulse of sound. Alternatively, the transducer 10 can be maintained in a biased condition in which electrical signals are generated as the layer 20 is moved by received sonic energy. In ultrasonic measuring systems such as disclosed in U.S. Pat. No. 4,887,246, incorporated here by reference, a transducer is used first to emit a sonic pulse and then to receive an echo returned from a target.

After the transducer is subjected to a dc bias potential for a period of time, the effect of the electrostatic attraction of the layer 20 toward the back plate 12 can decrease. The decrease results from charging of the dielectric material of the diaphragm 16 and cancellation of the electrostatic attraction force. The tendency of the charging effect to occur increases with higher temperature and increases with increasing time of application of the dc bias potential and increases with increased bias potential magnitude. Charging may result from movement of electrical charge between the surface 14 of the back plate 12 and the surface 22 of the diaphragm 16, or from polarization of the dielectric material of the diaphragm 16, or both. When charging occurs, the electrical potential near the surface 22 of the diaphragm 16, of the same polarity as the bias potential applied to the back plate 12, increases and can approach the bias potential. This potential interferes with or cancels out at least some of the attractive force caused by the dc bias voltage.

Decrease in the effect of the electrostatic attraction of the layer 20 toward the back plate 12 causes a decrease in the efficiency of operation of the transducer 10 in both generating and receiving sonic energy. The range of movement of the layer 20 in response to fluctuating electrical signals applied to the base plate 12 is reduced, and the amplitude of emitted sonic energy falls. When sonic energy is received, the layer 20 is farther from or is not pressed as tightly against the back plate surface 14 and the electrical output signals resulting from sound-induced movement of the diaphragm 16 are reduced.

The present invention eliminates the charging problem by periodically reversing the polarity of the applied dc bias voltage. The reversal is effected frequently enough so that charging does not degrade transducer performance, and is effected in timed relation to operation of the transducer to avoid conflict with the emission and receipt of sonic signals.

When used to emit sonic energy, the function of the transducer is the same with both polarities of applied dc bias voltage. In contrast, differences in polarity and the timing of signals can result from operating the transducer as a sound receiver with different bias polarities. These polarity and time differences are compensated for in the system and method of the present invention. As a result, the transducer can be used as both the transmitting and receiving element in an ultrasonic measuring system without degrading performance due to charging of the dielectric diaphragm.

Figure 2:
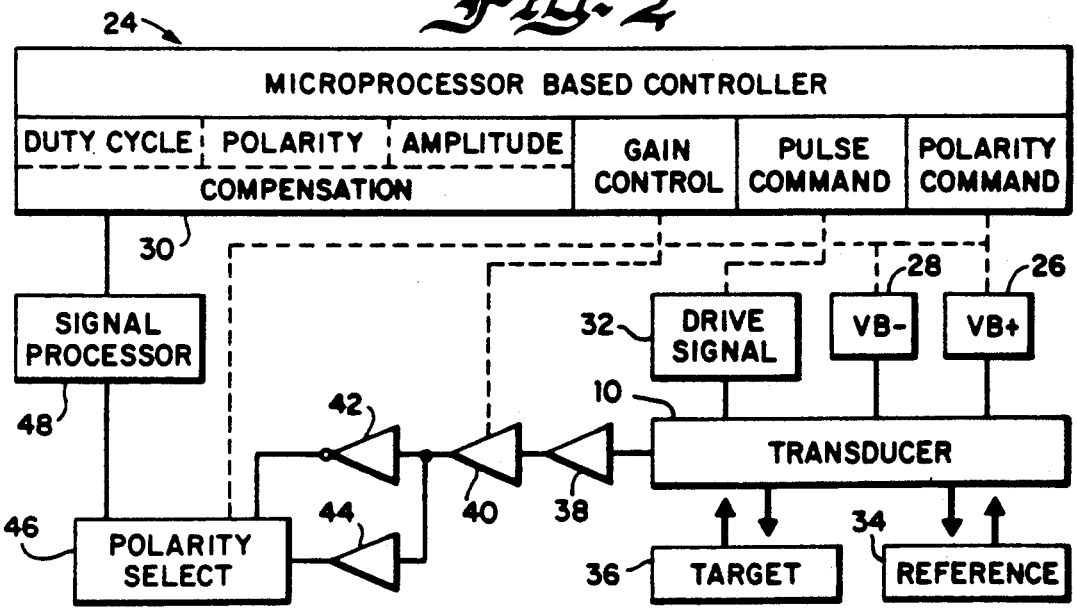
FIG. 2 is a block diagram illustrating the system and method of the present invention.

As seen in block diagram form in FIG. 2, the transducer system of the invention, designated as a whole by the reference character 24, includes two different bias voltage supplies 26 and 28 connected to the transducer 10. Circuit 26 supplies a positive bias voltage VB+ while circuit 28 supplies a negative bias voltage VB−. A microprocessor based controller 30 controls and performs a number of functions in connection with the operation of transducer 10 and system 24, some of these functions being indicated diagrammatically in FIG. 2. Reference may be made to U.S. Pat. No. 4,769,793 and 4,887,246 for more detailed descriptions, incorporated here by reference, of microprocessor functions beyond those related to the present invention.

A polarity command function implemented in the microprocessor controller 30 applies a polarity select signal seen in broken lines in FIG. 2 that enables either the circuit 26 or the circuit 28 to apply either a positive or a negative dc bias voltage to the transducer 10. In order to avoid charging of the transducer, the polarity of the dc bias applied to the transducer is periodically reversed by alternating the operation of circuits 26 and 28 in response to polarity commands. It is preferred that the duty cycle of the bias voltage supplies be equal so that an imbalance over time does not lead to undesired charging of the transducer dielectric. The microprocessor controller achieves the desired duty cycle by alternating the operation of the supplies 26 and 28 and by making other adjustments that may be required if the operating characteristics or requirements of the system 24 tend to cause an imbalance. The polarity select signal is designated as POL in FIGS. 3 and 4 referred to below.

A pulse command function implemented in the microprocessor controller 30 periodically applies a pulse control signal seen as a broken line in FIG. 2 to a driving signal circuit 32. In response to application of the periodic pulse control signal, the circuit 32 applies a fluctuating voltage to the transducer 10 to cause the transducer to emit sonic energy. Although various types of driving signals and energy emissions are possible, in the illustrated arrangement, the fluctuating voltage causes the transducer 10 to emit a pulse of sonic energy. The pulse control signal is designated as PLS is FIGS. 3 and 4 referred to below.

As indicated by arrows in FIG. 2, the sonic energy radiates toward a reference 34 and also toward a target 36. Reference 34 is an object, such as a fixed bar indicated in FIG. 1, that is known distance from the transducer 10. The reference 34 may include two different surfaces at different known distances from the transducer 10. Target 36 is an object that is located an unknown distance from the transducer 10. Further information about the structure and use of reference 34 may be found in U.S. Pat. No. 4,769,793 incorporated here by reference.

After emitting a pulse of sonic energy, the transducer 10 is operated as a receiver at a constant dc bias supplied by the selected one of the circuits 24 or 26. As indicated by arrows in FIG. 2, sonic energy reflected from reference 34 and from target 36 reaches the transducer 10 in the form of echoes. The reflected sonic energy is transformed by the transducer 10 into electrical signals that are processed and evaluated by the system 24 in order to determine the distance from the transducer 10 to the target 36.

Electrical signals corresponding to sonic energy received by transducer 10 are coupled through an input buffer 38 to a gain controlled amplifier block 40. A gain control function implemented in the microprocessor controller 30 applies a gain control signal seen as a broken line in FIG. 2 to the amplifier block 40 to provide gain compensation in the manner described more fully in U.S. Pat. No. 4,769,793 incorporated here by reference.

An output signal received during positive polarity biasing of transducer 10 with bias voltage VB+ is of a different polarity than an output signal received during negative polarity biasing with bias voltage VB−. In order to provide an output of consistent polarity, after amplification in block 40 the signal received by transducer 10 is coupled through an inverting buffer 42 and also through a noninverting buffer 44. The outputs from both of the buffers 42 and 44 are similar to one another but inverted. These outputs are coupled to a polarity select switch circuit 46 that selects the desired one of the pair of inputs under the control of the polarity command function implemented in the microprocessor controller 30. For example, inverted signals may be selected during negative bias operation, while noninverted signals are selected during positive bias operation. As a result, signals of uniform polarity are coupled from the polarity select circuit 46 to a signal processing circuit 48.

Signal processing circuit 48 functions to provide signals to the microprocessor based controller 30 that can be used for calculating the distance from the transducer 10 to the target 36 and that can also be used for system control functions including gain control of the amplifier block 40 and certain compensation functions described below. In circuit 48, output signals from the transducer 10 are compared with a reference minimum signal level to identify those signals that result from reflections from the reference 34 and from the target 36. Certain information concerning the reflected signals is extracted. Peak amplitudes of these reflected signals are detected, and a specific point representing a specific time in each reflected signal, such as a zero crossing point, is identified for use in determining distances from the transducer 10 and for system control functions. The extracted information is communicated in digital form to the microprocessor based controller 30.

In addition to the gain control function noted above, the microprocessor controller carries out additional control operations in order to avoid charging of the transducer 10 and in order to avoid the introduction of errors resulting from polarity control in operating the transducer 10. The additional operations include compensation for duty cycle, signal amplitude and signal polarity.

Referring first to the polarity compensation function, because of the bias voltage polarity changes made to prevent charging of the transducer, the signals received during positive and negative biasing of transducer 10 may require time compensation. For example, the different signal paths through the buffers 42 and 44 can introduce timing errors because of differences in the times required for signals to reach the microprocessor controller 30. These differences could lead to inaccuracy in determining the distance to be measured.

In order to eliminate this source of possible error, a polarity compensation function is implemented into the microprocessor controller 30. In operation, signals received during positive and negative biasing from the reference 34 are compared. Continuing or long term differences in computed distance are due to bias difference related factors because the actual distance between the transducer 10 and the reference 34 does not change with bias polarity. The polarity compensation function compensates for any such difference by offsetting one polarity in time relative to the other so that both polarities measure the reference distance consistently. In the manner disclosed in more detail in U.S. Pat. No. 4,769,793, signals resulting from reflection from the reference 34 are also used to maintain the accuracy of the transducer system 24 by compensating for shorter term changes in temperature, position and the like.

As indicated above, the microprocessor 30 is capable of adjusting the duty cycle of the circuits 26 and 28 so that the transducer is biased in both polarities for equal average times. This may involve simply alternating the operation of circuits 26 and 28 in timed relation with the periodic operation of the driving signal circuit 32. In some circumstances, an imbalance may result from simple alternating control. A duty cycle compensation function is implemented in the microprocessor based controller 30. In a manner similar to polarity compensation, measurements related to echoes from reference 34 are employed to compensate for any inaccuracies resulting from nonalternating bias operation, for example if circuit 26 or circuit 28 is enabled more than once in sequence.

Charging of the transducer 10 can occur despite the use of the polarity command function and the duty cycle compensation function. For example, the power supply used to supply the positive and negative bias voltages may not be balanced and the absolute values of the positive and negative voltages may differ. If so, even if the times that each polarity is used are equal, the average electrostatic field may not be zero and charging can result. Also, the dielectric material of the diaphragm 16 may be more susceptible to charging with one bias voltage than with the other. For these or similar reasons, charging may occur even if all other control functions of the system 24 operate as desired.

The amplitude compensation function implemented in the microprocessor controller 30 uses feedback control to prevent charging due to such causes and to avoid resulting errors. Charging of the dielectric has the effect of decreasing the sensitivity of the transducer 10 when the transducer is biased with the same polarity as the polarity of the undesired charge because of the fact that charges of the same polarity repel one another. If the transducer is charged negative, signal amplitude is less during negative bias operation, and if the transducer is charged positive, signal amplitude is less during positive bias operation. The amplitudes of signals received during positive and negative bias operation from the reference 34 are compared. If the transducer is free of charge and if there are no other polarity related imbalances, the amplitudes should be equal. If they are not, the amplitude difference is used to control corrective system functions.

Short term correction can be effected by using the gain control function to compensate for amplitude differences by increasing the gain of amplifier block 40 during the bias polarity when signal amplitude is decreased. To correct the problem more permanently, the charge condition of the transducer is changed by adjusting the duty cycle in order to make the signal amplitudes equal for both polarities. The duty cycle adjustment is made by altering the polarity control signal, for example by using the desired polarity more than once in sequence. The result of this control function is to assure that the transducer is free of charge or, if some other imbalance is present, to assure that the diaphragm is slightly charged in such a way as to counterbalance the other imbalance.

Figure 3:
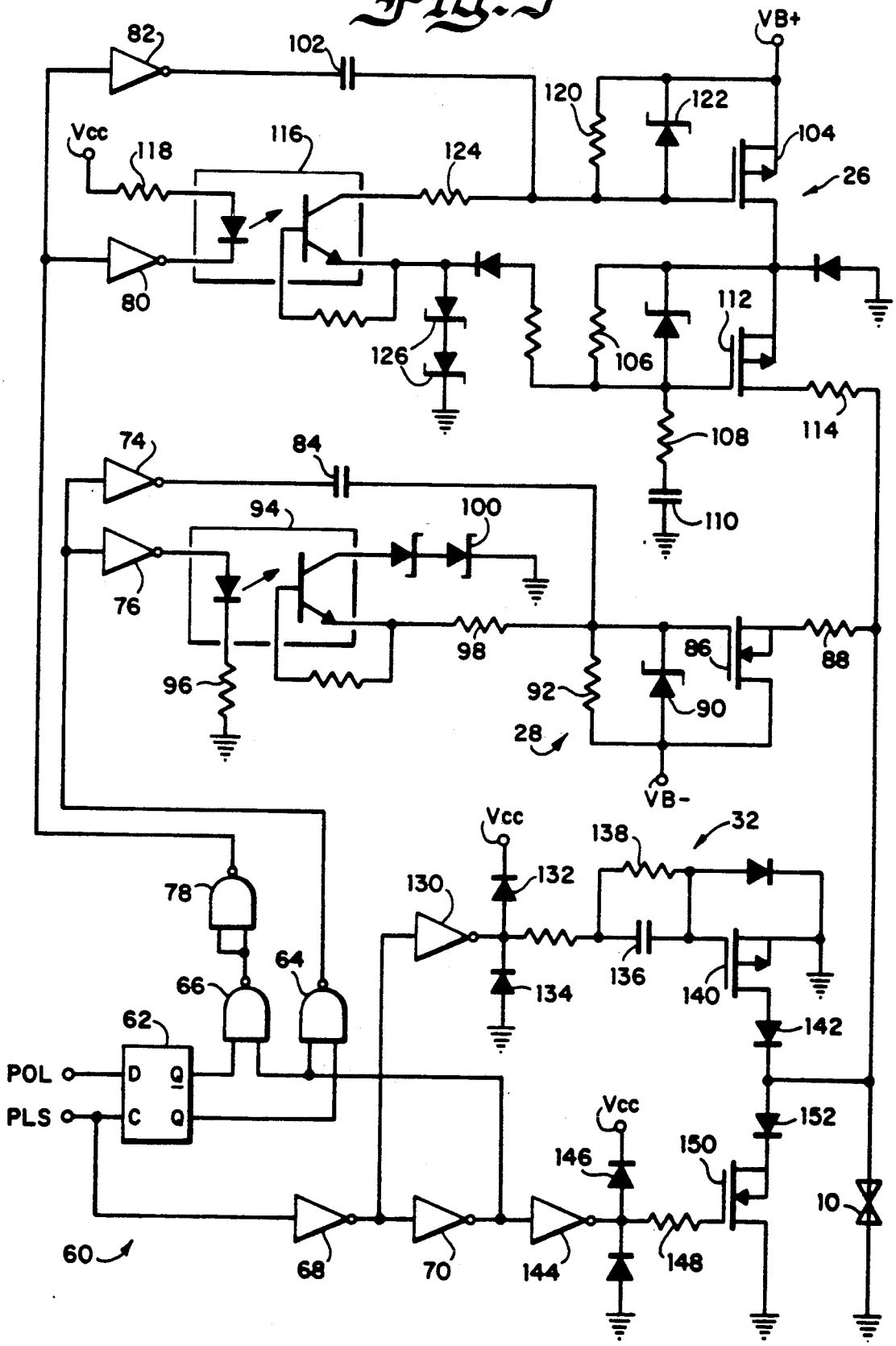
FIG. 3 is a schematic diagram of part of an electrical circuit for operating the transducer of FIG. 1 in accordance with the diagram of FIG. 2.

Part of the transducer system 24, including the bias voltage supply circuits 26 and 28 and the driving signal circuit 32, is shown in schematic form in FIG. 3. An input circuit 60 is coupled to circuits 26, 28 and 32 to control their operation in response to the polarity control signal POL and the pulse control signal PLS. The input circuit 60 controls the timing of polarity reversal and pulse generation to avoid conflicts and to achieve the result of eliminating charging of the dielectric of the transducer 10.

Figure 4:
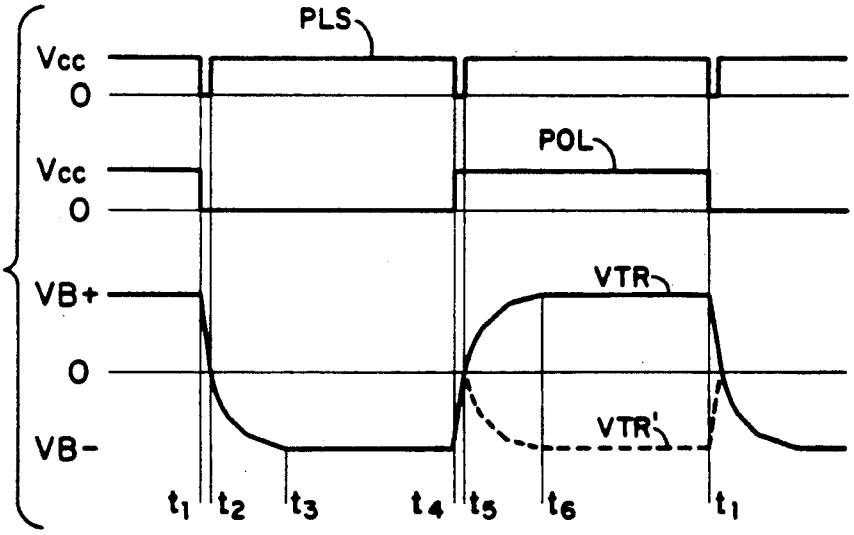
FIG. 4 is a diagram showing certain waveforms relating to operation of the electrical circuit of FIG. 3.

Circuit 60 includes a positive edge triggered flip-flop or bistable multivibrator 62 with its clock input C connected to receive the pulse control signal PLS and with its input D connected to receive the polarity control signal POL. When the positive going leading edge of an input signal is received at C, the signal at D is transferred to output Q and, in inverted form to output $\overline{Q}$. The waveforms of the control signals PLS and POL are seen in FIG. 4. The polarity control signal POL periodically alternates at times $t_1$, $t_4$ etc between zero and logic positive or Vcc volts. In the embodiment of the invention illustrated in the drawings Vcc may be about 6.5 volts. The pulse control signal PLS is normally at voltage Vcc and includes a regular series of pulses going negative to zero. Negative going leading edges of these pulses occur at $t_1$, $t_4$ etc., and positive going trailing pulse edges occur at times $t_2$, $t_5$ etc. In the preferred embodiment, the pulse repetition rate is about 100 Hz.

At each time $t_2$, the negative bias supply circuit 28 is enabled to apply negative bias VB− to the transducer 10 while the positive bias supply circuit 26 is disabled. At time $t_2$ the polarity signal POL is low at input D of flip-flop 62 and a positive going edge of pulse control signal PLS is received at clock input C of the flip-flop 62. In response to this positive going edge, the flip-flop 62 couples a positive signal coupled from output $\overline{Q}$ to one input of a NAND gate 64 having its other input ganged with an input of another NAND gate 66. Signal PLS is coupled through a pair of inverting buffers 68 and 70 and the output of gate 70, tied to the polarity of PLS, is connected to the ganged inputs of gates 64 and 66. Because both inputs of gate 64 are positive at time $t_2$, the output of gate 64 is negative and the outputs of two inverting buffers 74 and 76 at the input of bias supply circuit 28 are positive. As a result, circuit 28 is enabled to apply negative bias VB− to the transducer 10.

At this time $t_2$ one input of gate 66 is negative because it is connected to the noninverted output Q of the flip-flop 62. The other input is connected to the output of gate 70 and is positive. The positive output of gate 66 is inverted by a NAND gate 78 having commoned inputs and having its output connected to inverter buffers 80 and 82 at the input of bias supply circuit 26. The positive outputs of buffers 80 and 82 disable the positive bias supply circuit 26.

Circuit 28 includes a VB− input connected to a dc power supply (not shown). In the embodiment of the invention illustrated in the drawings, VB− may be about −300 volts. When circuit 28 is enabled at time $t_2$, a positive going signal is coupled from the output of buffer 74 through a capacitor 84 to the gate of a field effect transistor (FET) 86. FET 86 is quickly rendered conductive to connect the negative bias VB− to the transducer 10 through a resistor 88. Zener diode 90 and resistor 92 are connected between the gate and the source of the FET 86.

In order to maintain the FET 86 conductive independent of the initial signal coupled through the capacitor 84, an optically coupled light emitting diode and optically controlled transistor unit (optocoupler) 94 is connected between gate 76 and the FET 86. When the output of buffer 76 is positive, current flows through the input circuit of optocoupler 94 and a resistor 96. The optocoupler 94 is energized and a circuit path is completed from VB− to ground through resistor 92, a resistor 98, the output circuit of the optocoupler 94 and a pair of series connected zener diodes 100. Diodes 100 hold the voltage at the output of the optocoupler 94 near the voltage VB− to reduce drain on the dc power supply. The optocoupler 94 provides an isolating interface between the relatively low logic voltage level and the higher bias voltage level with minimum current draw.

At each time $t_5$ the positive bias supply circuit 26 is operated to apply positive bias VB+ to the transducer 10 while the negative bias supply circuit 28 is disabled. At time $t_4$ the polarity signal POL is high at input D of flip-flop 62 and a positive going edge of pulse control signal PLS is received at clock input C of the flip-flop 62 at time $t_5$. In response to this positive going edge, the flip-flop 62 couples a negative signal from output $\overline{Q}$ to one input of the NAND gate 66. The output of gate 70, tied to the positive polarity of PLS, is connected to the other input of gate 66. Because both inputs of gate 66 are positive at time $t_5$, the output of gate 66 is negative and the output of inverting gate 78 is positive. The outputs of the two inverting buffers 80 and 82 at the input of bias supply circuit 26 are negative. As a result, circuit 26 is enabled to apply positive bias VB+ to the transducer 10.

At this time $t_5$ one input of gate 64 is negative because it is connected to the inverted output $\overline{Q}$ of the flip-flop 62. The other input is connected to the output of gate 70 and is positive. The positive output of gate 64 is coupled to inverter buffers 74 and 76 at the input of bias supply circuit 28. The negative outputs of buffers 74 and 76 disable the negative bias supply circuit 28.

Circuit 26 includes a VB+ input connected to the dc power supply. In the embodiment of the invention illustrated in the drawings, VB+ is the inverse of VB− and may be about 300 volts. When circuit 26 is enabled at time $t_5$, a negative going signal is coupled from the output of buffer 82 through a capacitor 102 to the gate of a FET 104. FET 104 is quickly rendered conductive and current flows from VB+ through FET 104 to ground through resistors 106 and 108 and capacitor 110. A second FET 112 with its output circuit in series with the output circuit of FET 104 is gated on by the voltage across resistor 106 and VB+ is connected to the transducer 10 through a resistor 114. Two FETs in series are used to permit a reduction in component size because a single FET for controlling VB+ would be relatively large.

In order to maintain the FETs 104 and 112 conductive independent of the initial signal coupled through the capacitor 102, an optocoupler 116 is connected between gate 80 and the FET 106. When the output of buffer 80 is negative, current flows through a resistor 118, optocoupler 116 is energized and a circuit path is completed from VB+ to ground through resistor 120 and zener diode 122, resistor 124, optocoupler 116 and series connected zener diodes 126. Diodes 126 hold the voltage at the output of the optocoupler 114 near the voltage VB+ to reduce drain on the dc power supply. The optocoupler 116 provides an isolating interface between the relatively low logic voltage level and the higher bias voltage level with minimum current draw.

The periodic negative going pulses of the pulse control signal PLS control the driving signal circuit 32 to apply a fluctuating or varying voltage signal to the transducer 10 and cause the transducer 10 to emit sonic energy. The voltage at the transducer 10 consists of the applied bias voltage summed with these voltage fluctuations. This applied voltage, designated as VTR, is seen in FIG. 4. In the embodiment of the invention illustrated in the drawings, the voltage fluctuation is created by periodically connecting the back plate 12 of the transducer 10 to ground for the duration of each pulse so that the voltage across the transducer 10 changes from the dc bias voltage to zero, resulting in a pulse of sonic energy. However, in using the transducer 10 as a source or receptor of sonic energy, many other types of signals can be superimposed on the dc bias voltage.

From time $t_1$ to time $t_2$ and from time $t_4$ to $t_5$, a negative voltage is applied to inverting buffer 68 and a positive voltage is present at the inputs to inverting buffers 70 and 130. The negative output of gate 130 is coupled through a toggle diode pair 132 and through a resistor 134, through a capacitor 136 and resistor 138 and to the gate of a FET 140. The FET 140 is rendered conductive and any negative voltage present at the transducer 10 is shunted to ground through the FET 140 and a diode 142.

In a similar manner, negative voltage at the output of gate 70 is applied to the input of an inverting buffer 144. The positive output from gate 144 is coupled across a toggle diode pair 146 and through a resistor 148 to the gate of a FET 150. FET 150 is rendered conductive and any positive voltage present at transducer 10 is shunted to ground through FET 150 and a diode 152.

At the end of each pulse of the PLS signal, the driving signal circuit is returned to its normal condition in which the transducer 10 is disconnected from ground so that it can be supplied with a dc bias of a polarity selected by the polarity command signal POL. At time $t_2$ and at time $t_5$ the signal PLS returns to its high value. Gates 68, 70 and 144 return FET 150 to its nonconductive condition. Gates 68 and 130 return FET 140 to its nonconductive condition.

The input gating circuit 60 is controlled by the signals POL and PLS to time the operation of circuits 26, 28 and 32 so that conflict is avoided between the polarity reversal function and the emission of pulses. At the beginning of each pulse of signal PLS, both bias supply circuits 26 and 28 are prevented from operating. As a result, regardless of which circuit 26 or 28 is enabled by the polarity command function, that circuit is disabled at the time that circuit 32 is operated to generate a sonic output. This mode of operation has the advantage of increasing the efficiency of operation when sound pulses are emitted.

The output of gate 70 is connected to one input of gate 64 and to one input of gate 66. The output of gate 70 is negative during each pulse of signal PLS. Circuit 26 is enabled only when both inputs of gate 66 are positive, and circuit 28 is enabled only when both inputs of gate 64 are positive. As a result neither circuit 26 or 28 is enabled during pulses of the pulse control signal PLS.

In operation of the system 24 including the transducer 10, just prior to time $t_1$ the transducer is supplied with dc bias voltage VB+ and the diaphragm 16 is pressed tightly against the back plate 12 (FIG. 1) by electrostatic force. At time $t_1$ the circuit 26 is disabled to discontinue the application of dc bias and at the same time the transducer 10 is grounded by operation of the driving signal circuit 32 as controlled by pulse control signal PLS. As seen in FIG. 4, the voltage VTR on the transducer 10 abruptly changes from VB+ to zero. The electrostatic force attracting the diaphragm 16 against the back plate 12 is discontinued. Tension applied to diaphragm 16 causes at least portions of the diaphragm 16 to move away from the back plate 12. This movement generates a sonic pulse emitted from the transducer 10.

During the time from $t_1$ to $t_2$ the decrease in electrostatic attraction is not opposed by an uninterrupted bias voltage because circuit 26 is disabled. This tends to increase the magnitude of the emitted sonic energy. In addition, the time delay incident to disabling the circuit 26 is proceeding while the sonic pulse is emitted. At time $t_2$ when the pulse of the control signal PLS terminates, the circuit 32 returns to its standby condition and the direct connection of the transducer 10 to ground is disconnected.

Beginning at time $t_2$ the circuit 28 is enabled to apply negative dc bias VB− to the transducer 10. Between time $t_2$ and time $t_3$ the voltage VTR (FIG. 4) decreases in an asymptotic curve from zero to approach VB−. Due to resistance and capacitance in the system, this change is more gradual than the change that occurs when circuit 32 is operated to emit a pulse of sonic energy. At time $t_3$ a near steady state negative dc bias condition is reached with the diaphragm 16 electrostatically attracted against the back plate 12. From time $t_3$ to time $t_4$, the transducer operates in a listening or receiving mode in which sonic energy reflected from the reference 34 and the target 36 causes electrical signals to be supplied from the transducer 10 to the buffer 38 and other signal processing components seen in FIG. 2.

At time $t_4$ the negative bias supply circuit 28 is disabled and the circuit 32 is operated to connect the transducer 10 to ground. The attraction of the diaphragm 16 to the back plate 12 is interrupted, and the diaphragm 16 is freed and emits a sonic pulse by moving away from contact with the back plate 12. At time $t_5$ the positive bias supply circuit 26 is enabled, and the voltage on the transducer 10 increases from zero to approach VB+ at time $t_6$. From time $t_6$ until the next recurrence of time $t_1$ the transducer is again maintained in a listening or receiving mode.

Between time $t_2$ and time $t_4$ the dielectric material of the diaphragm 16 is subjected to an electric field between the relatively negative back plate 12 and the relatively positive conductive layer 20. Over time, this field can tend to charge the dielectric either by contact with the back plate 12 or by polarization or both. Conversely, between time $t_5$ and the next occurrence of time $t_1$, the dielectric material of the diaphragm 16 is subjected to an electric field between the relatively positive back plate 12 and the relatively negative conductive layer 20. Over time, this field can also tend to charge the dielectric. If the transducer is operated with a bias of only either single polarity, undesirable charging of the transducer 10 can occur. Such charging if unchecked impairs the ability of the transducer 10 to emit sonic energy in response to applied voltage fluctuations as well as the ability to provide electrical signals in response to received sonic energy. Reversing the polarity of the dc bias on a periodic basis solves this problem by preventing charging of the dielectric film 16.

The waveforms of FIG. 4 and the related description correspond to operation when the polarity is reversed with each pulse in the pulse control signal PLS. The polarity command and amplitude compensation functions of the microprocessor based controller 30 can alter this operation to achieve the control functions referred to above. Rather than reversing in polarity with every pulse of PLS, a desired polarity may be maintained for two or more pulses either to correct a duty cycle disparity or to correct a transducer charge condition causing polarity related amplitude differences. In this case, the operation is similar to that described above except that the polarity of the POL signal coupled to input D of the flip-flop 62 may not change with each pulse of PLS and the voltage VTR applied to the transducer 10 may repeat rather than alternating. An example in which a sequence of negative bias voltage VB− applications is used is shown in broken lines and designated as VTR' in FIG. 4.

While the invention has been described with reference to details of the embodiments illustrated in the drawings, such details are not intended to limit the scope of the invention as set forth in the following claims.

What is claimed is:

1. A capacitive transducer system comprising:
a transducer having spaced capacitively coupled electrodes;
a conductive back plate providing one of said electrodes;
a diaphragm overlying said back plate;
said diaphragm including a dielectric film with a metal layer on the surface of said film opposed to said back plate, said metal layer providing the other of said electrodes;
a bias circuit connected to said transducer for applying a bias voltage between said electrodes for biasing said transducer to an operating condition;
a signal circuit connected to said electrodes and including means for applying voltage fluctuations to said transducer;
and the improvement characterized by said bias circuit including polarity control means for periodically reversing the polarity of said bias voltage to decrease charging of said dielectric film.

2. A capacitive transducer system as claimed in claim 1, said bias circuit including first means for connecting a positive dc bias voltage to said back plate and second means for connecting a negative dc bias voltage to said back plate, said polarity control means including means for operating one or the other of said first and second means.

3. A capacitive transducer system as claimed in claim 2, said polarity control means including means for establishing duty cycles of said first and second means by alternating the operation of said first and second means.

4. A capacitive transducer system as claimed in claim 3, said polarity control means including means for equalizing the duty cycles of said first and second means.

5. A capacitive transducer system as claimed in claim 1, said signal circuit including means for selectively reversing the polarity of signals received from said transducer in accordance with the polarity of said bias voltage.

6. A capacitive transducer system as claimed in claim 1, said applying means including a shunting circuit for periodically shunting said back plate to ground to emit a pulse of sonic energy from said transducer 7. A capacitive transducer system as claimed in claim 6 further comprising system control means for operating said shunting circuit in time relation with operation of said polarity control means.

8. A capacitive transducer system as claimed in claim 7, said control means discontinuing said bias voltage at the time of operation of said shunting circuit.

9. A method of operating a capacitive transducer of the type including a conductive back plate and a dielectric film with a metal coating overlying the back plate, said method comprising the steps of:

applying a dc voltage to the back plate and metal film to attract the metal film toward the back plate with an electrostatic force;

transferring to the transducer from a signal circuit electrical signals for moving the metal film relative to the back plate; and periodically reversing the polarity of the applied dc potencial.

10. A method of operating a capacitive transducer of the type including a conductive back plate and a dielectric film with a metal coating overlying the back plate, said method comprising the steps of:

periodically emitting a sonic pulse by discontinuing all dc bias to the transducer while applying a fluctuating bias to the traducer;

applying a dc bias to the transducer between said periodic emissions; and reversing the polarity of the applied dc bias to avoid charging of the dielectric film.

11. A method as claimed in claim 10 further comprising using the transducer to provide electrical signals caused by reception of sonic energy between said periodic emissions.

12. A method as claimed in claim 11 wherein said reversing step is performed at the conclusion of at least two of said periodic emissions.

13. A control system for a capacitive transducer of the type having a dielectric diaphragm subject to charging, said system comprising:

a source of positive dc bias potential;

a source of negative dc bias potential;

first switching means for connecting one of said sources to the transducer;

second switching means for connecting the transducer to ground; and control means connected to said first and said second switching means for operating said second switching means at intervals and for operating said first switching means to alternate bias polarities during sequential intervals.

14. A capacitive transducer system comprising:

a transducer having spaced capacitively coupled electrodes;

a conductive back plate providing one of said electrodes;

a diaphragm overlying said back plate;

said diaphragm including a dielectric film with a metal layer on the surface of said film opposed to said back plate, said metal layer providing the other of said electrodes;

a bias circuit connected to said transducer for applying a bias voltage between said electrodes for biasing said transducer to an operating condition;

a signal processor circuit connected to said electrodes and including means for receiving and extracting information from signals received from said transducer;

and the improvement characterized by said bias circuit including polarity control means for periodically reversing the polarity of said bias voltage to decrease charging of said dielectric film.

15. A capacitive transducer system as claimed in claim 14, further comprising polarity compensation means for adjusting the timing of signals received during different bias polarities.

16. A capacitive transducer system as claimed in claim 14, said bias circuit including first means for connecting a positive dc bias voltage to said back plate and second means for connecting a negative dc bias voltage to said back place, said polarity control means including means for operating one or the other of said first and second means.

17. A capacitive transducer system as claimed in claim 16, said polarity control means including means for establishing duty cycles of said first and second means by alternating the operation of said first and second means.

18. A capacitive transducer system as claimed in claim 17, said polarity control means including means for equalizing the duty cycles of said first and second means.

19. A capacitive transducer system as claimed in claim 14, said applying means including a shunting circuit for periodically shunting said back plate to ground to emit a pulse of sonic energy from said transducer.

20. A capacitive transducer system as claimed in claim 19 further comprising system control means for operating said shunting circuit in timed relation with operation of said polarity control means.

21. A capacitive transducer system as claimed in claim 20, said control means discontinuing said bias voltage at the time of operation of said shunting circuit.

22. A method of operating a capacitive transducer of the type including a conductive back plate and a dielectric film with a metal coating overlying the back plate, said method comprising the steps of:

applying a dc voltage to the back plate and metal film to attract the metal film toward the back plate with an electrostatic force;

transferring from the transducer to a signal circuit electrical signals resulting from movement of the metal film relative to the back plate; and periodically reversing the polarity of the applied dc potencial.

* * * * *